US008382605B2

(12) United States Patent
Treadwell

(10) Patent No.: US 8,382,605 B2
(45) Date of Patent: Feb. 26, 2013

(54) GOLF PUTTER

(76) Inventor: Douglas Ames Treadwell, Grosse Ile, MI (US)

( * ) Notice: Subject to any disclaimer, the term of this patent is extended or adjusted under 35 U.S.C. 154(b) by 230 days.

(21) Appl. No.: 12/714,438

(22) Filed: Feb. 26, 2010

(65) Prior Publication Data

US 2010/0222153 A1 Sep. 2, 2010

Related U.S. Application Data

(60) Provisional application No. 61/208,911, filed on Feb. 27, 2009.

(51) Int. Cl.
*A63B 53/06* (2006.01)

(52) U.S. Cl. ..... 473/251; 473/340

(58) Field of Classification Search ..... 473/251, 473/340

See application file for complete search history.

(56) References Cited

U.S. PATENT DOCUMENTS 6,019,686 A 2/2000 Gray
6,267,689 B1 * 7/2001 Ambrose ..... 473/251
6,464,599 B1 * 10/2002 Wolf ..... 473/328
6,485,375 B1 * 11/2002 McKinley ..... 473/245
6,988,955 B2 * 1/2006 Stoakes ..... 473/242
7,297,073 B2 * 11/2007 Jung ..... 473/340
7,485,047 B2 2/2009 Evans
7,485,051 B2 2/2009 Richard

* cited by examiner

*Primary Examiner* — Michael Dennis
(74) *Attorney, Agent, or Firm* — Mastrogiacomo PLLC

(57) ABSTRACT

A golf putter head is provided that includes a base element, the base element including a golf ball striking surface, at least one alignment rail, a lip, the lip extending the entire front width of the golf putter head and a top surface, the top surface located at the rear of the golf putter head, an upper plate the upper plate configured to be secured to the base element at the lip and the top surface, the upper plate includes at least one aperature and the upper plate completely covering the top surface. The upper plate further includes at least one indicator marking, the at least one indicator marking configured to align with the at least one alignment rail and the aperature is sized such that the at least one alignment rail may be viewed through the aperature. The mass of the putter head is distributed such that the mass of the upper plate is greater than the mass of the base element, thereby positioning the center of gravity of the putter head above a centerline of the golf ball striking surface and an equator of a golf ball when the golf ball is positioned proximate the golf ball striking surface of the golf putter head.

18 Claims, 8 Drawing Sheets

GOLF PUTTER

CROSS REFERENCE TO RELATED APPLICATIONS

This patent application claims the benefit of priority based on U.S. Provisional Patent Application No. 61/208,911 filed on Feb. 27, 2009, which is incorporated by reference in its entirety for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to golf clubs, and, more specifically to a golf putter.

2. Background Art

The golf club has undergone numerous design iterations since the dawn of the game of golf. While the driver, fairway woods and irons have benefited from material improvements over the years, they have largely maintained their original geometries. The golf putter, however, has been subjected to many different design iterations in hopes of engineering a putter that will make a difference between a birdie and a bogey.

Traditional golf putters have been designed and engineered such that the bulk of the putter head weight is distributed at the bottom or in the base of the putter. One of the disadvantages of this type of putter head design may be observed when a golf ball is struck by the putter face. Because the bulk of the weight of the putter head is distributed in the base of the putter, below the equator of the ball, much of the force of the putter will strike the lower portion of the ball forcing a backspin in the ball. The force of the putter and the induced backspin will cause the ball to jump into the air and skid upon landing. As the ball skids across the ground the ball will begin to lose velocity. The skidding of the ball as well as the loss of velocity will cause the ball to deviate from the intended path to the target.

The golf putter shaft has also been the subject of many design iterations. The shaft attaches to the putter head and extends in such a manner as to allow one to create a swinging motion in the putter head. In many putter designs, the shaft is secured to the putter head in a manner that positions the shaft at the heel (location in head nearest the individual) of the putter. With the shaft secured at the heel of the putter, the toe (location in head furthest from the individual) of the putter is left to move freely during a swing. If the ball is not struck at the center of the putter face, the putter head and shaft will twist in the hand of the individual attempting the shot resulting in the ball deviating from the intended path to the target.

Ensuring that one is properly aligned with respect to the putter and addressing the golf ball prior to the shot is critical to making a good golf shot. Typically, a marking or indicator is added to the top of the putter to aid one in lining up the center of the putter head with the golf ball and the intended target. While the indicator may aid one in aligning the center of the putter with the center of the golf ball, they do not, however, help to position an individual properly to make a good shot at the target. The head of an individual should be positioned directly over the putter such that their sight line is vertically downward and generally perpendicular to the putter head and the golf ball. If the individual is not properly aligned, the ball may travel in an unintended direction when struck by the putter.

Therefore, a need exists for a golf putter having a putter head design that distributes weight in such a manner to reduce or eliminate any backspin that is introduced to the golf ball when the putter face strikes the ball. A need also exists for a golf putter that will minimize any twisting motion of the shaft in the hands of an individual during a golf shot and will also provide markings or indicators that will allow one to properly align themselves with respect to the putter, the golf ball and target.

BRIEF SUMMARY OF THE INVENTION

A golf putter head is provided that includes a base element, the base element including a golf ball striking surface, at least one alignment rail, a lip, the lip extending the entire front width of the golf putter head and a top surface, the top surface located at the rear of the golf putter head, an upper plate the upper plate configured to be secured to the base element at the lip and the top surface, the upper plate includes at least one aperture and the upper plate completely covering the top surface. The upper plate further includes at least one indicator marking, the at least one indicator marking configued to align with the at least one alignment rail and the aperture is sized such that the at least one alignment rail may be viewed through the aperature. The mass of the putter head is distributed such that the mass of the upper plate is greater than the mass of the base element, thereby positioning the center of gravity of the putter head above a centerline of the golf ball striking surface and an equator of a golf ball when the golf ball is positioned proximate the golf ball striking surface of the golf putter head.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
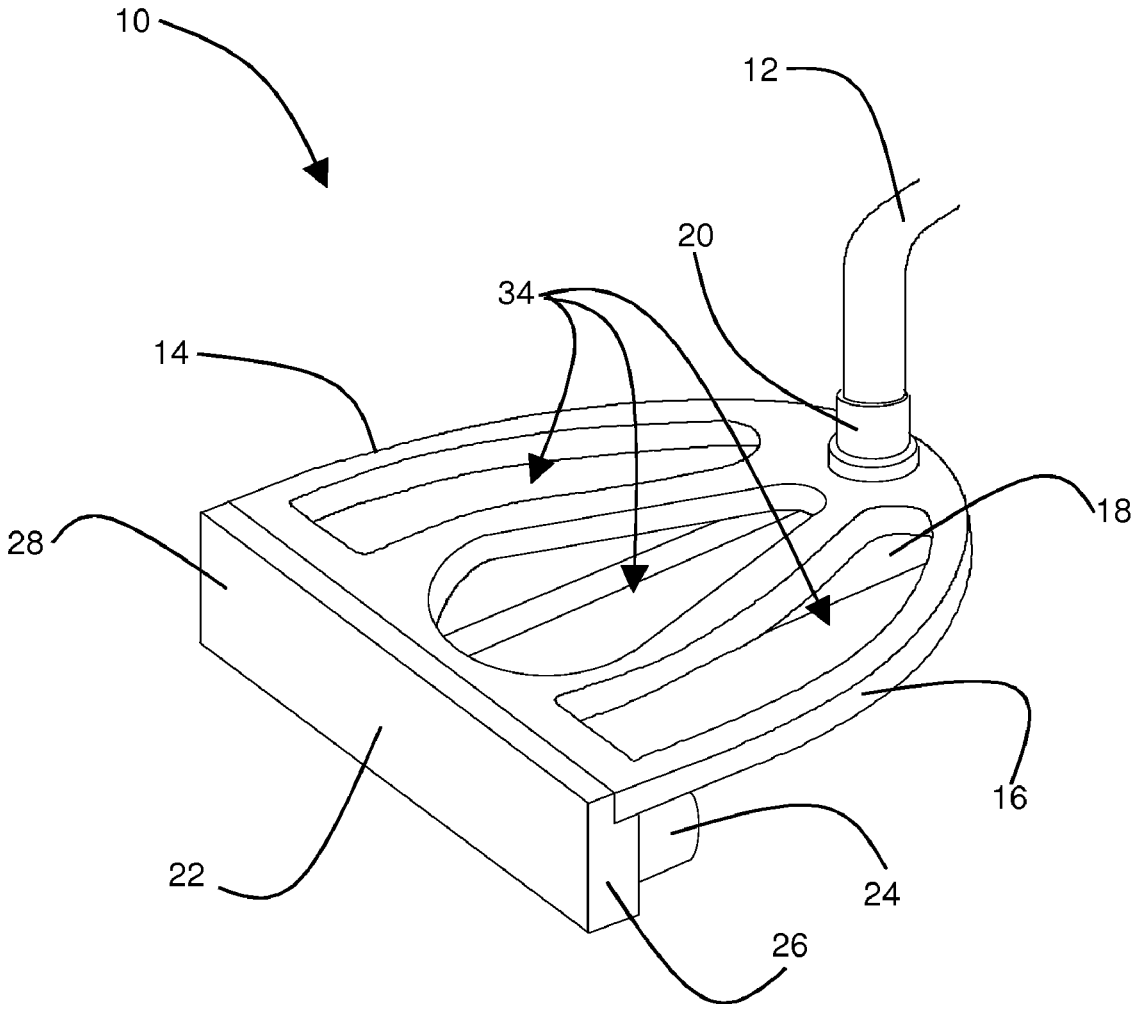
FIG. 1 is a perspective view of a golf putter according to an embodiment of the present invention.

Referring now to the drawings, a preferred illustrative embodiment of the present invention is shown in detail. Although the drawings represent an embodiment of the present invention, the drawings are not necessarily to scale and certain features may be exaggerated to better illustrate and explain the present invention. Further, the embodiment set forth herein is not intended to be exhaustive or otherwise to limit or restrict the invention to the precise forms and configurations shown in the drawings and disclosed in the following detailed description.

A golf putter 10 is illustrated in FIG. 1 according to an embodiment of the present invention. Putter 10 includes a putter head 14 and a shaft 12 that is secured to and extends from head 14. Shaft 12 may include a grip (not shown) that may be attached at an end of shaft 12 that is opposite the end of the shaft that is secured at head 14. An individual attempting a golf shot with the putter will generally hold putter 10 at the grip and position themselves to address the golf ball. Typically, shaft 12 extends a length from head 14 that will allow an individual to induce a swinging motion in putter 10 allowing them to strike a golf ball with putter head 14.

Referring now to FIGS. 1-7, putter head 14 of the present invention will be described in greater detail. In an embodiment, putter head 14 includes an upper plate 16 and a base 18. Upper plate 16 includes a hole 36 for accepting and securing a hosel 20 to upper plate 16. Hosel 20 is used to secure shaft 12 to putter head 14 near the center rear of putter head 14. Upper plate 16 may also include apertures 34 to reduce the overall weight of putter 10 and to aid the individual in properly aligning themselves with putter 10 and the golf ball (to be described in greater detail below).

Figure 6A:
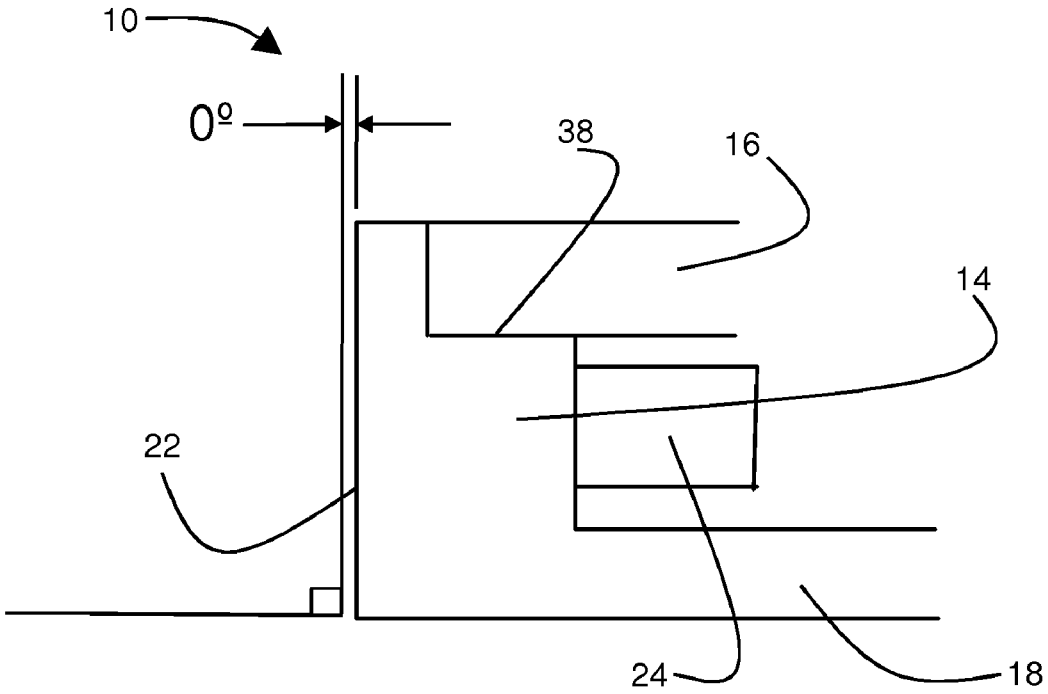
FIGS. 6A and 6B are exploded views of the golf putter shown in FIG. 5 according to an embodiment of the present invention.
Figure 6B:
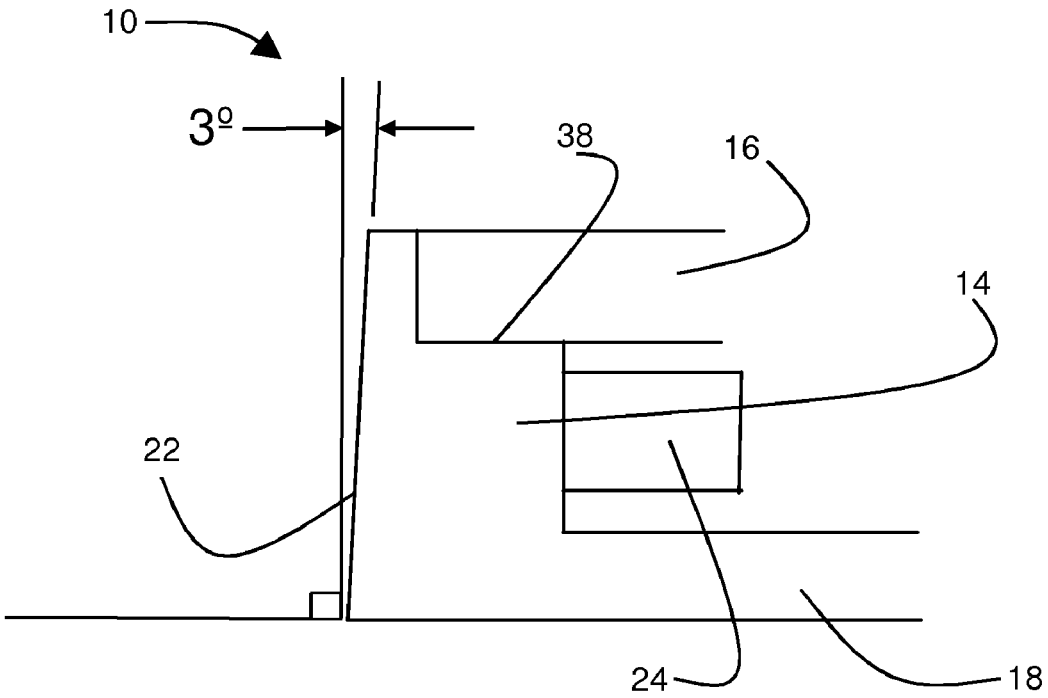

Base 18 includes a lip 38 positioned across the front width of the putter head 14 and a top surface 40 at the rear of head 14 for positioning and securing upper plate 16 to base 18. Base 18 further includes a face or striking surface 22 that extends the front width of putter head 14 and is used for striking a golf ball. When putter head 14 is positioned on a flat surface, the angle of face 22 relative to the surface may range from being generally perpendicular to angling rearward a few degrees as illustrated in FIGS. 6A and 6B. When the golf ball comes to rest on a putting surface, the ball may sit in a depression that has been created by the weight of the ball. Using a putter having a face with no angle, or, alternatively, a face with a slight angle rearward will aid in propelling the ball out of the depression. Typically, the rearward angle may range from 0° to 5° from a bottom of putter head 14 to a top of putter head 14.

The front width of base 18 includes a heel edge 26 and a toe edge 28. Heel and toe are designations typically given to a putter head and coincide with whether the individual will swing the putter right-handed or left-handed. Generally the heel will be closest to the individual and the toe at the furthest point on the putter from the individual. In this particular description of the invention, heel 26 and toe 28 will be discussed and shown in the illustrations as if the individual were to swing putter 10 from a right-handed stance.

Figure 7:
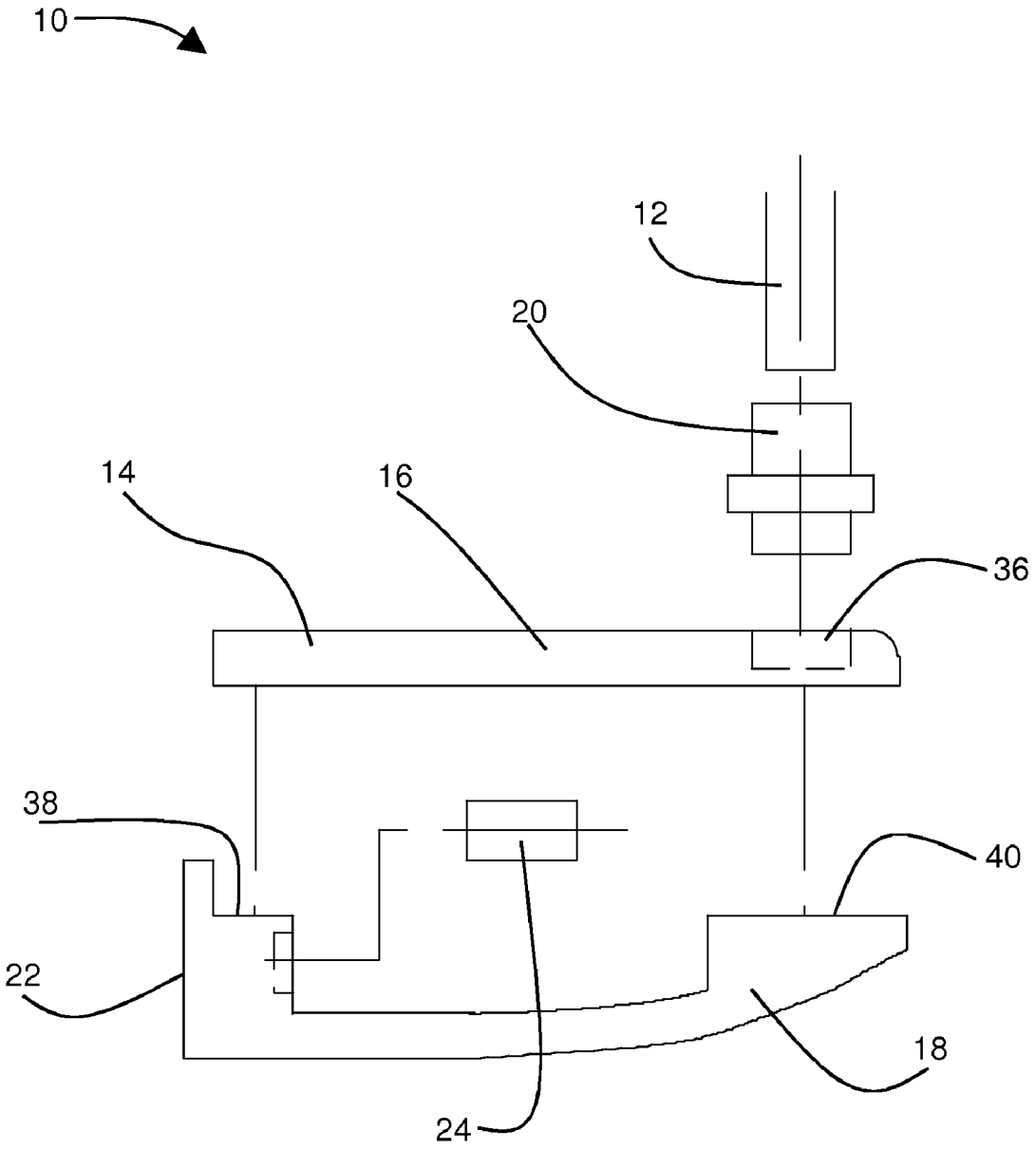
FIG. 7 is an exploded view of the golf putter according to an embodiment of the present invention.

Weights 24 may be added to putter head 14 and secured to base 18 at heel 26 and toe 28 as illustrated in FIG. 7. Weights 24 may be fastened to base 18 by any means. In this particular embodiment, weights 24 will be secured to base 18 with a separate screw or bolt (not shown). Alternatively, threads may be added to an end of weight 24 such that weight 24 may be directly screwed into base 18. Weights 24 may also be secured to base 18 by other means, for example gluing or welding.

By using fasteners such as screws, bolts, or threading weights 24 themselves, weights 24 may be easily removed from base 18. Weights 24 may also be provided in a number of different sizes and weights to allow the individual to adjust the weight of putter 10 and to provide the individual with greater flexibility when selecting the weight and feel of putter 10. Adjustable weighting elements will aid the individual in determining the proper putter head weight to fit their desired level of comfort and ability while putting.

Golf putter 10 may be assembled in the following manner. Putter head 14 comprises a number of components as discussed above. Upper plate 16 may be assembled to base 18 at lip 38 and top surface 40 as illustrated in FIG. 7. Upper plate 16 may be secured to base 18 by both gluing the mating sections of upper plate 16 and base 18. Alternatively, any type of fasteners, such as screws or bolts and nuts, may be used to secure upper plate 16 to base 18. Upper plate 16 and base 18 may also be welded together. Hosel 20 may be added to upper plate 16 near the rear and center of putter head 14. Hosel 20 may be press fit into upper plate 16 and may be secured to upper plate 16 by any means including, but not limited to, gluing, welding, press fit, etc. Shaft 12 may be secured to putter head 14 at hosel 20. Shaft 12 is positioned and may be slid into hosel 20 and may be secured to putter head 14 at hosel 20 by any means, including, but not limited to, gluing, welding, press fit, etc.

Along with changeable weights 24, putter head 14 has a light weight center to provide for a very high moment of inertia for both heel 26 and toe 28 of putter head 14. These two features, light weight center of putter head 14 and adjustable weights, allow for improved stability of putter 10 as the club is swung in a putting motion. The weighting configuration significantly reduces the amount of twisting in putter head 14 during a swinging motion. A reduction in the twisting of putter head 14 during off-center or miss hits of the golf ball will aid in maintaining the ball on the desired path toward the target or hole.

Upper plate 16 may be manufactured from any material. Typically, upper plate 16 may be manufactured from any type of metal, such as steel, aluminum, brass or the like. Base 18 may also be manufactured from any material and typically may be manufactured from any type of metal such as steel, aluminum, brass or the like. In an embodiment of the present invention, upper plate 16 and base 18 may be manufactured from materials such that the mass of upper plate 16 will be greater than the mass of base 18. For example, upper plate 16 may be manufactured from any type of steel while base 18 may be manufactured from a lighter weight material such as aluminum.

Putter 10 may be used in the following manner. Generally, putters are one club of many that are used to play golf on a typical golf course. Usually putters are used on or slightly off the green as a means of propelling a golf ball toward a hole. The face of the putter is used to strike the golf ball as the individual swings the shaft and the putter head into the ball. In an embodiment of the present invention, upper plate 16 is manufactured of a heavier material than base 18. Because upper plate 16 will have a greater mass than base 18, the bulk of the weight or the center of gravity of putter head 14 will be above a centerline of face 22. The heavier upper plate 16 will provide a greater inertial force in face 22 of putter 10 above this centerline. When a golf ball is struck by putter 10 and face 22, the greater mass located above the center line of face 22 and the equator of the golf ball will tend to induce a topspin in the golf ball as it is propelled forward by face 22 of putter 10.

The topspin will create a gyroscopic effect in the golf ball causing the ball to travel a shorter distance in the air after first being struck by putter 10, reduce the amount of skid the golf ball may otherwise undergo with a bottom weighted putter and maintain a straighter path toward the target or hole.

Figure 4:
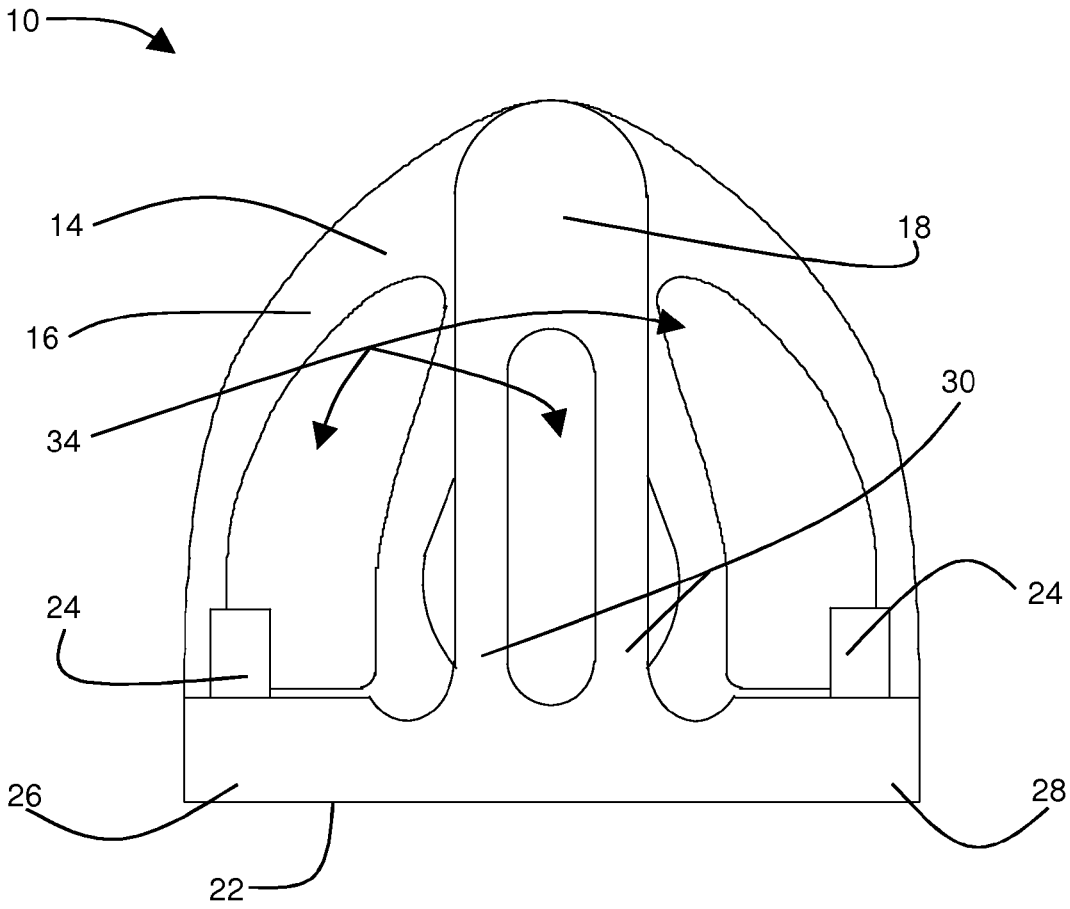
FIG. 4 is a bottom view of the golf putter according to an embodiment of the present invention.
Figure 5:
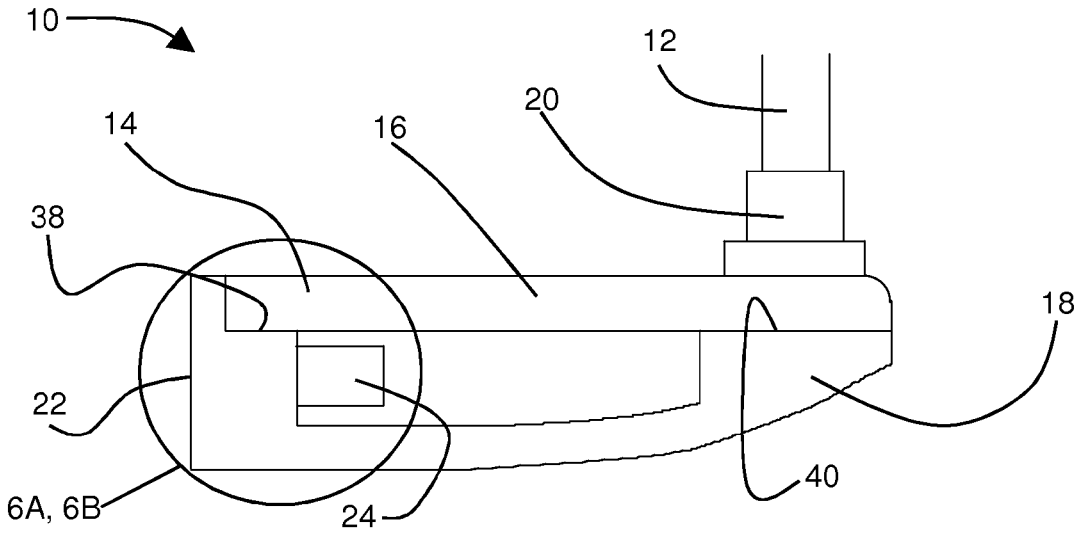
FIG. 5 is a side elevation view of the golf putter according to an embodiment of the present invention.
Figure 8:
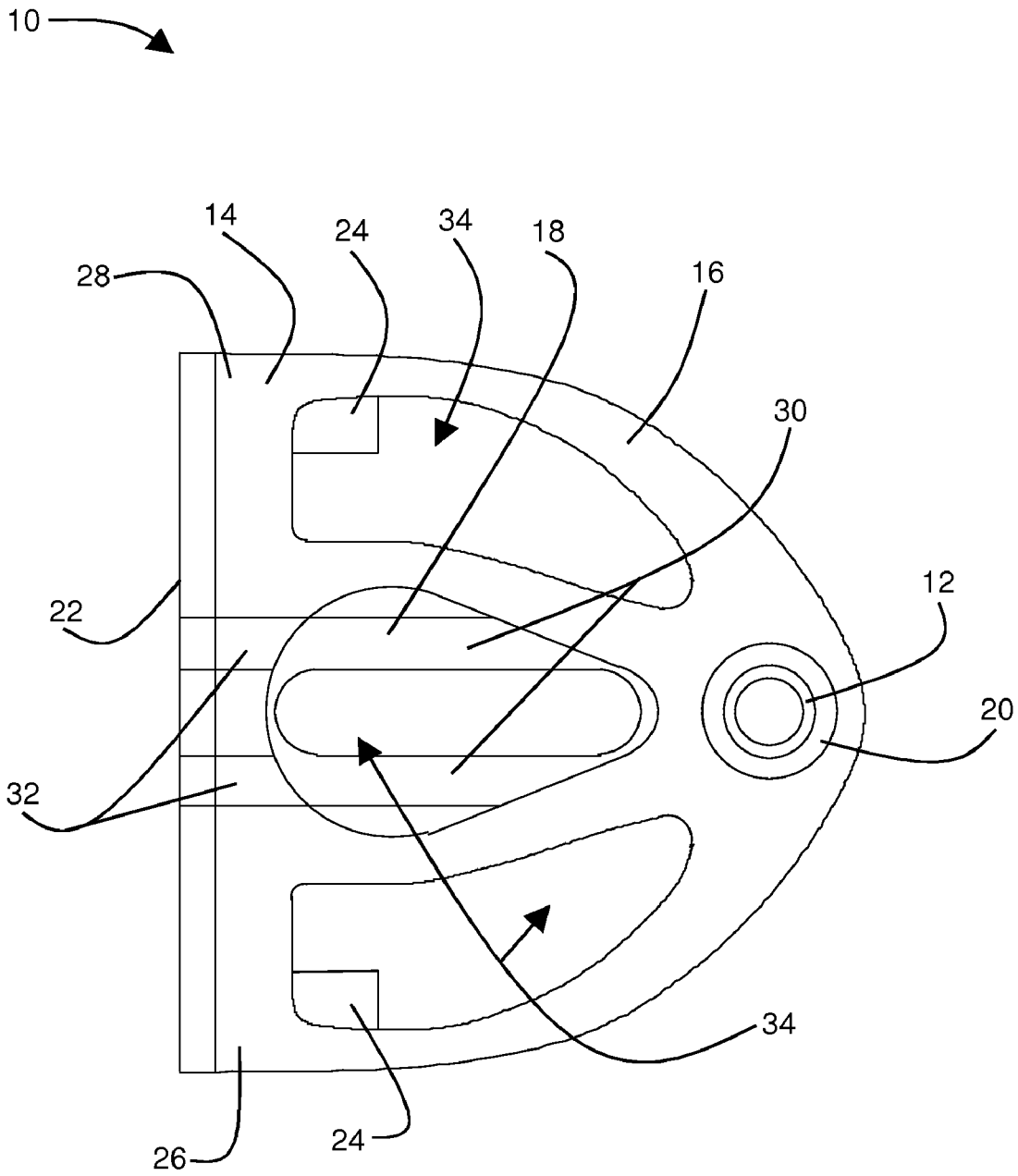
FIG. 8 is a top view of a golf putter according to another embodiment of the present invention.

As illustrated in FIG. 4, upper plate 16 and base 18 are generally separated from each other near the middle of putter head 14. As discussed above, upper plate 16 includes apertures 34 for viewing alignment rails 30 that are incorporated as a part of base 18. Included on putter head 14 is a pair of markings or indicators 32 that align with rails 30 when viewed from above. In this particular embodiment of the present invention, as illustrated in FIG. 8, indicators 32 are shown across a top surface of base 18 and upper plate 16. It is important to note, however, the indicators 32 may be included on only base 18 or, alternatively, on upper plate 16 only. Indicators 32 may include any style of markings to aid the individual in aligning putter 10 with the ball and the target. For example, indicators 32 may be a pair of small channels or raised strips in the material of upper plate 16 and base 18, or paint markings, or any combination of painted channels or strips.

Figure 2:
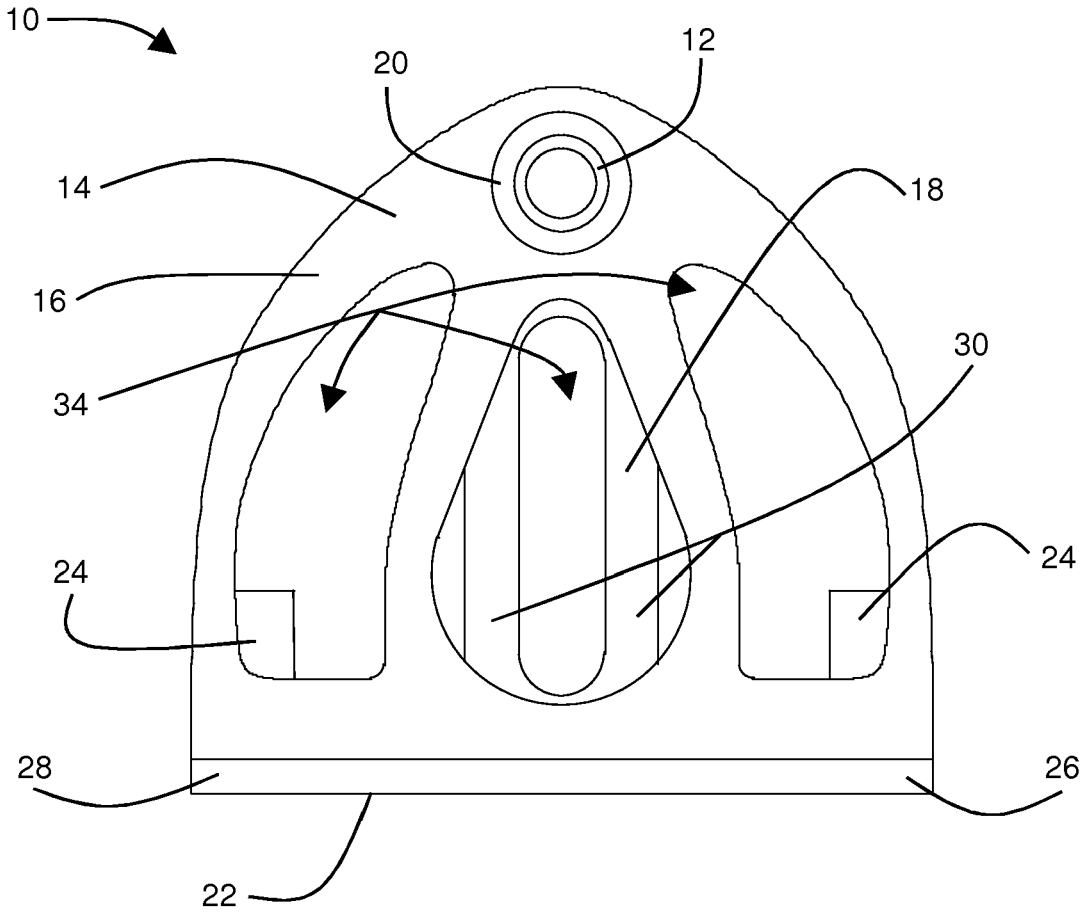
FIG. 2 is a top view of the golf putter according to an embodiment of the present invention.
Figure 3:
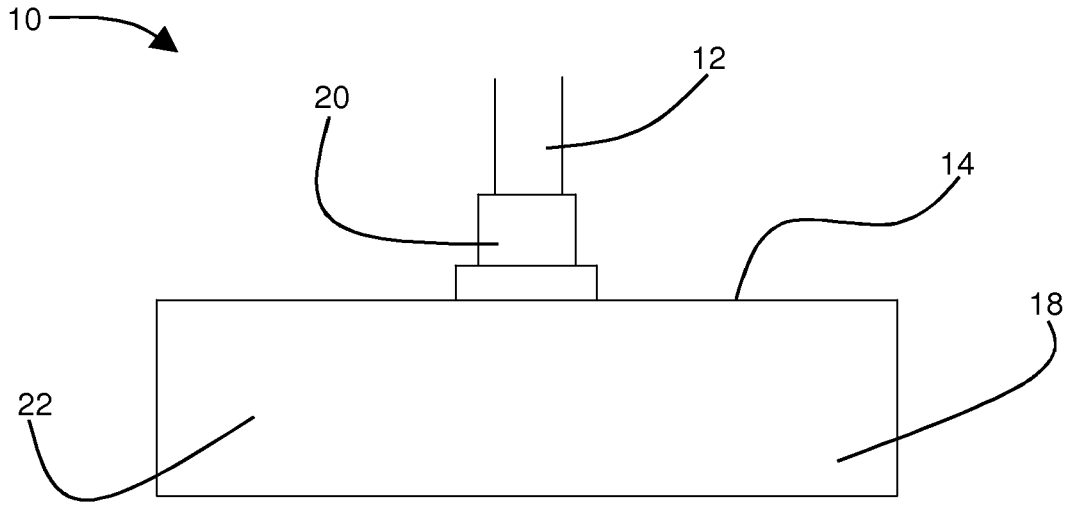
FIG. 3 is a front view of the golf putter according to an embodiment of the present invention.

When putter head 14 is viewed from above as illustrated in FIGS. 2 and 8, indicators 32 align with rails 30. The separation of upper plate 16 and base 18 as well as rails 30 and indicators 32 will provide an individual with an easy alignment check to ensure that the eyes of the individual are over the center of putter head 14. Proper alignment over the center of the putter head has been shown to greatly improve the ability of the individual to correctly aim the putter at the desired target. If an individual is not properly aligned over the center of putter head 14, indicators 32 will not align with rails 30 and the individual may not have putter 10 and the golf ball correctly aligned with the target.

As illustrated in FIGS. 1 and 2, shaft 12 is positioned and secured to putter head 14 near the rear and center of putter head 14 relative to face 22. This provides for the main force of the putting stroke to be directly behind the golf ball when putter 10 and the ball are properly aligned. This will help to ensure that face 22 will make a solid impact with the ball as well as aiding to further reduce any club head twisting. As described above, an opportunity to limit twisting of putter head 14 will aid to keep golf balls that are struck off-center by putter head 14 on the path toward the target or hole.

The location of shaft 12 near the center rear of putter head 14 and additional weighting at the upper rear of the club will create an increase in momentum that will drive putter head 14 through the impact zone. As face 22 impacts the golf ball, shaft 12 will still be traveling through the downward swing arc. Putter head 14 will continue through the impact zone, essentially feeling to the individual as if the club is swinging itself. The result of combining all the above components into one putter results in a putter with dramatically improved stability and stroke efficiency for golfers of all abilities.

Figure 9:
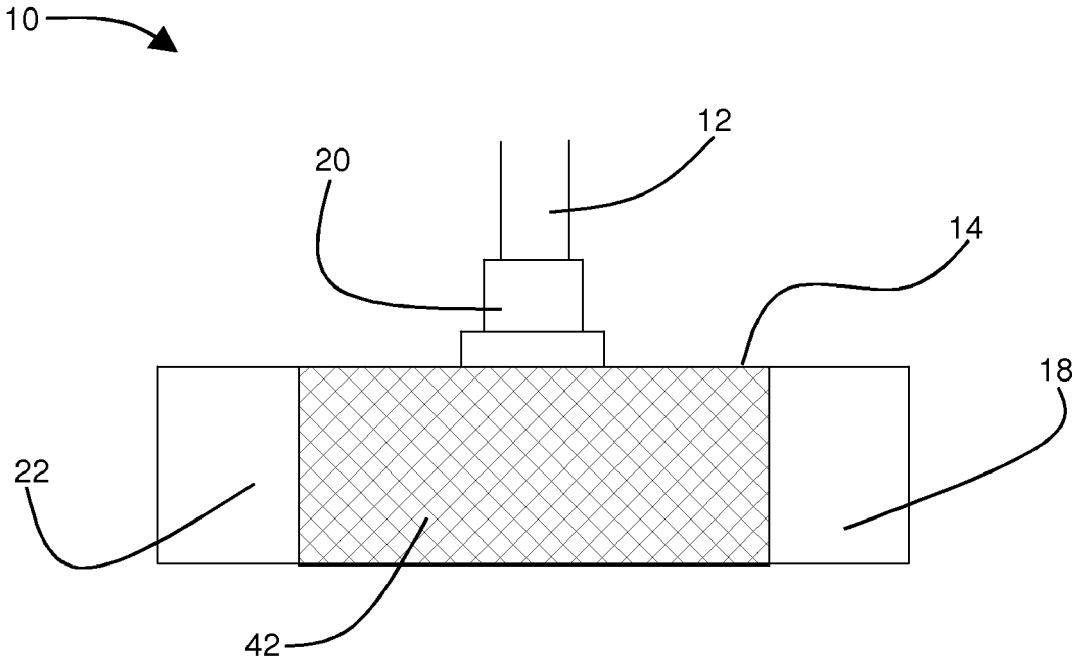
FIG. 9 is a front view of a golf putter according to another embodiment of the present invention.

FIG. 9 illustrates another embodiment of the present invention. In this particular embodiment, face 22 of putter head 14 includes a rough surface 42. Rough surface 42 may extend from the bottom to the top of face 22 and from the side at heel 26 to the side at toe 28. Although, rough surface 42 is described as covering face 22 entirely, it is important to note, however, that rough surface 42 may cover only a portion of face 22, as shown in FIG. 9, and perform equal as well. Rough surface 42 may be configured in any design on face 22, such as, for example, a square, circle, triangle, etc. Rough surface 42 may be manufactured onto face 22, such as, for example, a rough diamond surface, or, alternatively rough surface 42 may be a strip of material, such as, for example, sandpaper, and attached to face 22 with any type of adhesive.

Including rough surface 42 on face 22 will aid putter 10 in producing topspin in the golf ball. When face 22 contacts the ball, as putter 10 is swung through the bottom arc of a typical putting motion and into an upswing, the increased friction of rough surface 42 (over a typical semi-smooth surface) will grab the surface of the ball thereby inducing a topspin and propelling it in a forward motion toward the hole or target. As stated above, the topspin that has been induced in the golf ball will aid in keeping the ball on the intended path toward the hole or target.

Figure 10:
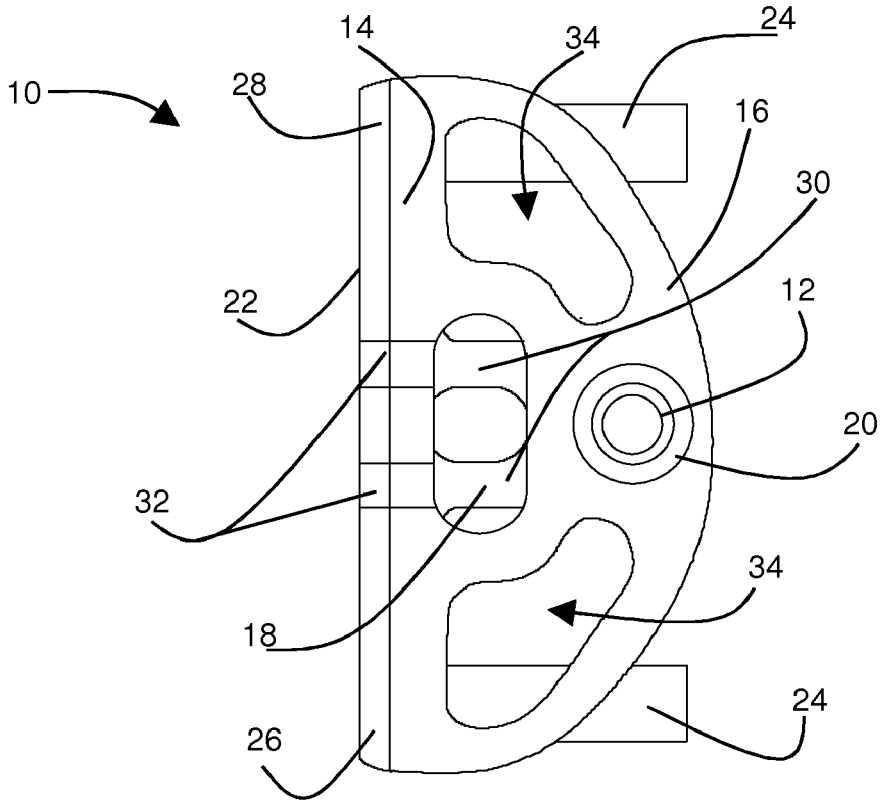
FIG. 10 is a top view of a golf putter according to yet another embodiment of the present invention.
Figure 11:
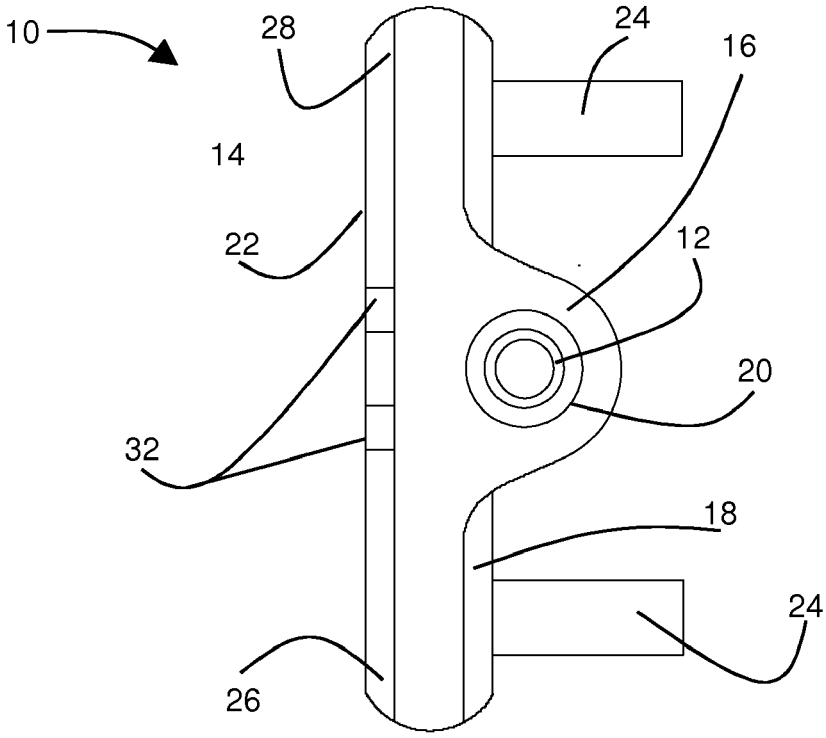
FIG. 11 is a top view of a golf putter according to still another embodiment of the present invention.

FIG. 10 illustrates an alternative configuration of putter head 14 and putter 10 according to another embodiment of the present invention. FIG. 11 illustrates still another alternative configuration of putter head 14 and putter 10 according to yet another embodiment of the present invention. In both of these particular embodiments, upper plate 16 is still manufactured of a heavier material than base 18. As mentioned above, because upper plate 16 will have a greater mass than base 18, the bulk of the weight or the center of gravity of putter head 14 will be above a centerline of face 22. The heavier upper plate 16 will provide a greater inertial force in face 22 of putter 10 above this centerline. When a golf ball is struck by putter 10 and face 22, the greater mass located above the center line of face 22 and the equator of the golf ball will tend to induce a topspin in the golf ball as it is propelled forward by face 22 of putter 10. The topspin will create a gyroscopic effect in the golf ball causing the ball to travel a shorter distance in the air after first being struck by putter 10, reduce the amount of skid the golf ball may otherwise undergo with a bottom weighted putter and maintain a straighter path toward the target or hole.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents by covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A golf putter head comprising: a base element, said base element including a golf ball striking surface; a lip, said lip extending the entire front width of said golf putter head; and a top surface, said top surface located at the rear of said golf putter head: an upper plate, said upper plate configured to be secured to said base element at said lip and said top surface, said upper plate completely covering said top surface; and wherein the mass of said putter head is distributed such that the mass of said upper plate is greater than the mass of said base element, thereby positioning the center of gravity of said putter head above a centerline of said golf ball striking surface and an equator of a golf ball when the golf ball is positioned proximate said golf ball striking surface of said putter head; wherein said upper plate includes at least one aperture; wherein said base element includes at least one alignment rail, wherein said upper plate includes at least one indicator marking, said at least one indicator marking configured to align with said at least one alignment rail and wherein said aperture is sized such that said at least one alignment rail may be viewed through said aperture.

2. The golf putter head as recited in claim 1, wherein said upper plate includes a first hole.

3. The golf putter head as recited in claim 1, wherein said base element includes a heel edge and a toe edge.

4. The golf putter head as recited in claim 1, wherein said base element includes at least one indicator marking, said at least one indicator marking configured to align with said at least one alignment rail and wherein said aperture is sized such that said at least one alignment rail may be viewed through said aperture.

5. The golf putter head as recited in claim 2, wherein said upper plate includes a hosel attached at said first hole.

6. The golf putter head as recited in claim 5, wherein said upper plate is configured to accept a shaft at said hosel.

7. The golf putter head as recited in claim 6, wherein said first hole is positioned at the rear and center of said upper plate with respect to said striking surface, thereby positioning said shaft at the rear and center of said putter head.

8. The golf putter head as recited in claim 1, wherein said striking surface includes a rough surface.

9. The golf putter head as recited in claim 1, further including at least one adjustable weight, said adjustable weight configured to change the moment of inertia of said putter head.

10. The golf putter head as recited in claim 1, wherein said striking surface is generally perpendicular to said upper plate.

11. The golf putter head as recited in claim 1, wherein said striking surface is angled rearward between 0° and 5° toward said hosel at said upper plate.

12. A golf putter comprising: a putter head including: a base element, said base including: a golf ball striking surface; a lip, said lip extending the entire front width of said golf putter head; a top surface, said top surface located at the rear of said golf putter head; a heel edge; and a toe edge; an upper plate, said upper plate including a first hole and said upper plate configured to be secured to said base element at said lip and said top surface: said upper plate completely covering said top surface; a hosel, said hosel being secured to said upper plate at said first hole; at least one adjustable weight, said adjustable weight configured to change the moment of inertia of said putter head; a shaft, said shaft being secured to said upper plate at said hosel; and wherein the mass of said putter head is distributed such that the mass of said upper plate is greater than the mass of said base element, thereby positioning the center of gravity of said putter head above a centerline of said golf ball striking surface and an equator of a golf ball when the golf ball is positioned proximate said golf ball striking surface of said golf putter; wherein said base plate includes at least one alignment rail and wherein said upper plate includes at least one indicator marking, said at least one indicator marking configured to align with said at least one alignment rail.

13. The golf putter head as recited in claim 12, wherein said upper plate includes at least one aperture.

14. The golf putter head as recited in claim 12, wherein said base plate includes at least one indicator marking, said at least one indicator marking configured to align with said at least one alignment rail.

15. The golf putter head as recited in claim 12, wherein said first hole is positioned at the rear and center of said upper plate with respect to said striking surface, thereby positioning said shaft at the rear and center of said putter head.

16. The golf putter head as recited in claim 12, wherein said striking surface includes a rough surface.

17. The golf putter head as recited in claim 12, wherein said striking surface is generally perpendicular to said upper plate.

18. The golf putter head as recited in claim 12, wherein said striking surface is angled rearward between 0° and 5° toward said hosel at said upper plate.

* * * * *